US005110056A

United States Patent [19]

Blasczyk et al.

[11] Patent Number: 5,110,056

[45] Date of Patent: May 5, 1992

[54] METHOD AND APPARATUS FOR REDUCING BRITTLE MATERIAL FOR SUBSEQUENT GRINDING

[75] Inventors: Gotthardt Blasczyk; Norbert Patzelt, both of Beckum, Fed. Rep. of Germany

[73] Assignee: Krupp Polysius AG, Fed. Rep. of Germany

[21] Appl. No.: 652,604

[22] Filed: Feb. 8, 1991

[30] Foreign Application Priority Data

Feb. 20, 1990 [DE] Fed. Rep. of Germany ..... 4005323

[51] Int. Cl.[5] ..... B02C 23/12

[52] U.S. Cl. ..... 241/19; 241/24; 241/34; 241/76; 241/78; 241/79.1; 241/80

[58] Field of Search ..... 241/24, 19, 29, 152 A, 241/79.1, 80, 97, 34, 78, 76

[56] References Cited

U.S. PATENT DOCUMENTS 4,703,897 11/1987 Beisner et al. ..... 241/152 A X
4,728,044 3/1988 Duill et al. ..... 241/78 X
4,732,334 3/1988 Muller et al. ..... 241/152 A X
4,783,012 11/1988 Blasczyk et al. ..... 241/152 A X

FOREIGN PATENT DOCUMENTS 3407535 9/1985 Fed. Rep. of Germany .

*Primary Examiner*—Mark Rosenbaum
*Attorney, Agent, or Firm*—Learman & McCulloch

[57] ABSTRACT

The invention relates to a method and a grinding plant for reduction of brittle material for grinding, in which material which has undergone primary reduction from a first grinding stage is delivered as fresh material to the second mill of a second grinding stage and finished product is removed from this second grinding stage, and in which the quantity of feed material of this second mill is kept constant when the quantity of finished product alters by altering the quantity of fresh material. This first grinding stage contains an air separator from which the fines are fed as fresh material to the second mill. In the event of alteration in the quantity of fresh material for the second grinding stage the quantity is kept constant by corresponding alteration of the fineness of separation of the separator of the first grinding stage. In this way a reliable and sensitive adaptation of the total throughput quantity of the second mill is achieved by relatively simple means when the finished product removed from the second grinding stage alters.

10 Claims, 2 Drawing Sheets

METHOD AND APPARATUS FOR REDUCING BRITTLE MATERIAL FOR SUBSEQUENT GRINDING

FIELD OF THE INVENTION

The invention relates to a method and apparatus of two-stage reduction of brittle material for grinding and to a grinding plant for two-stage reduction of brittle material for subsequent grinding, in which cement materials in particular are to be reduced as brittle material for grinding.

BACKGROUND OF THE INVENTION

A method and plant are known from DE-A-34 07 535 according to which a material bed roller mill with two rollers is used for primary crushing in a first stage as a first mill, and in this case a proportioning belt scale is coordinated with this roller mill as a feed arrangement for fresh material. The material which has undergone primary crushing in this roller mill is all fed to the mill of a second grinding stage together with the quantity of recycled material (separated oversize material or tailings) coming from a separator of this second grinding stage. In this known construction the throughput capacity is regulated in such a way that when the throughputs alter in the second grinding stage which operates as a closed-circuit grinding system, for example because of an altered quantity of final product, a control intervention into the regulating arrangement of this second grinding stage ceases, whilst the particular alteration in the throughput capacity of the second grinding stage is transferred by means of the proportioning belt scale co-ordinated with the roller mill (first grinding stage) by way of an alteration in the speed of rotation of the rollers of this roller mill, whilst a control signal coming from the second grinding stage is processed first of all for adapting the control action of the proportioning belt scale and accordingly then a further control signal is processed for appropriate adaptation of the speed regulation of the rollers of this roller mill.

SUMMARY OF THE INVENTION

The object of the invention is to provide an improved method and apparatus for the two-stage grinding of brittle material in such a way that with a particularly sensitive adaptation of the material for subsequent grinding which is to be fed to the second mill of the second grinding stage a relatively high throughput capacity is achieved for this mill and a relatively simple and reliable adaptability of the throughput capacity of the first grinding stage to that of the second grinding stage is ensured.

According to the invention this is achieved on the one hand by a combination with method features according to the characterising portion of claim 1 and on the other hand with a combination of apparatus features according to the characterising portion of claim 8.

Advantageous embodiments and further developments of the invention are set out in the subordinate claims.

In this construction according to the invention the first grinding stage with the first mill and an appertaining air separator is constructed in the form of a closed-circuit grinding system. Since the material which has undergone primary reduction coming from the first mill is first of all classified in the appertaining first air separator into oversize material (tailings) which is returned to the first mill as a quantity of recycled material and fine material which is delivered to the second mill of the second grinding stage as a quantity of fresh material (second quantity of fresh material), material for grinding which is still too coarse can be kept away from this second mill which serves for fine reduction of this material, so that this second mill can be charged with a relatively narrowly defined particle size distribution in the feed material, which in turn can lead to a more uniform fine reduction in this second mill and a higher throughput capacity in this second grinding stage.

According to the invention, in both grinding stages the total supply of material for grinding is kept constant by co-ordinated regulating arrangements. In this case, as already mentioned, the fines from the air separator of the first grinding stage then form the quantity of fresh material for the second mill of the second grinding stage, so that if the quantity of finished product from this second grinding stage alters the quantity of material for grinding delivered to the second mill can be kept constant by influencing the air separator of the first grinding stage for the purpose of a quantity of fresh material of feed material which is necessary in the second mill. According to the invention this can be achieved in a simple, rapid and reliable manner by virtue of the fact that the air separator of the first grinding plant has a fineness adjustment device with a drive which is infinitely variable in speed.

In a particularly preferred embodiment of the invention the first grinding stage and the second grinding stage operate in the manner of a closed-circuit grinding system each with a mill and a separator wherein the quantity of first fines is varied corresponding to an alteration of the quantity of second oversized material by adjusting the fineness of separation in the first separator to maintain constant the total quantity of first fines and second oversized material delivered to the second mill, and wherein the quantity of fresh material is varied corresponding to an alteration of the quantity of first oversized material to maintain constant the total quantity of first oversized material and fresh material delivered to the first mill.

In the aforementioned embodiment of the air separator with a fineness adjustment device it is particularly advantageous to use a distributor plate or cage air separator. It is particularly preferred to use a cage air separator as the air separator for each grinding stage in which a relatively simple and rapid adjustment of the fineness of separation for the proportion of fines can be achieved by continuous adjustment of the drive for the rotating cage inside the separating chamber.

THE DRAWINGS

The invention will be described below with the aid of the drawings, in which.

DETAILED DESCRIPTION

Figure 1:
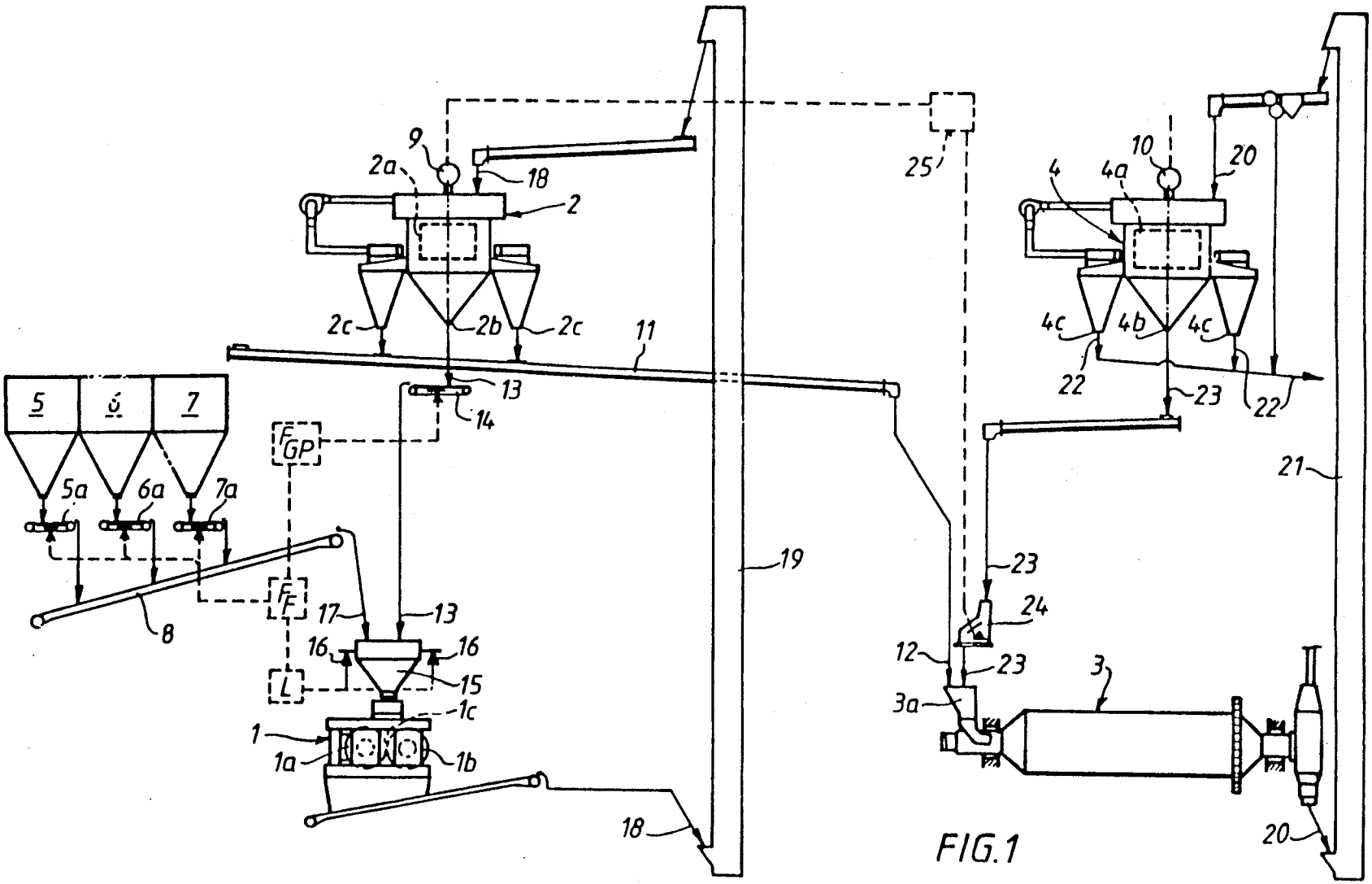
FIG. 1 shows a simplified flow diagram of the entire grinding plant with two grinding stages constructed as closed-circuit grinding systems, according to a first embodiment.

In the first embodiment of the entire grinding plant illustrated in FIG. 1, for the sake of clarity only the parts of the plant which are necessary for explanation of this construction according to the invention are principally shown, whilst filter arrangements, drive motors, particularly for conveying and proportioning arrangements, switching and control arrangements, etc., which are known per se have been largely omitted.

The embodiments of the grinding plant which are described below with the aid of the drawings serve in particular for the two-stage reduction of brittle material for grinding, particularly of cement materials such as cement clinker, slag and the like.

According to the flow diagram in FIG. 1 the entire grinding plant contains as essential components a first grinding stage constructed in the form of a closed-circuit grinding system for the primary reduction of material grinding with a first mill 1 and a first air separator 2, as well as a second grinding stage which is also constructed in the form of a closed-circuit grinding system and connected after the first grinding stage and intended for the fine reduction of material for grinding with a second mill 3 and a second air separator 4; in addition several storage bunkers 5, 6, 7 can be provided for different components of the material for grinding, and proportioning belt scales 5*a*, 6*a*, 7*a* or other proportioning arrangements which act on a feed arrangement 8, for example a conveyor belt, which is controllable in its conveying capacity, for fresh material to the first mill 1 are arranged under each storage bunker 5, 6, 7 in a manner which is known per se.

Although the air separators used in the first grinding stage and in the second grinding stage can be of any suitable construction which is known per se and which offers possibility of adjustment of the fineness of separation, it is preferred for at least the air separator 2 of the first grinding stage to be constructed as a centrifugal air separator, particularly a cage air separator of a design which is known per se. It is particularly preferable for the first air separator 2 of the first grinding stage and the second air separator 4 of the second grinding stage to be constructed as cage air separators which are similar in principle. In this case in a manner which is known per se each air separator 2, 4 has a rotating cage 2*a*, 4*a* respectively which is only indicated by broken lines in the region of the inner separating chamber. This separating cage 2*a* or 4*a* essentially forms a fineness adjustment device for which the speed and thus the desired fineness of separation can be set by means of a drive motor 9 or 10 which is infinitely variable in speed.

The first air separator 2 in the first grinding stage has an outlet 2*b* for oversize material or tailings as well as at least one outlet 2*c* for fines, preferably several such fines outlets 2*c*. These fines outlets supply a connecting conveyor 11 of a connecting arrangement which conveys the fines coming from this first separator 2 to the material inlet 3*a* of the second mill 3 as a quantity of fresh material (arrow 12). The quantity of oversize material (tailings) coming out of this first air separator 2—according to the arrow 13—as the first quantity of recycled material is first of all determined by a quantity measuring arrangement constructed for example as a belt scale 14 and then delivered to the feed shaft 15 for material for grinding immediately above the feed point of the first mill 1. The filling level of this feed shaft 15 can be controlled as regards the total quantity of feed material of this first mill 1 by means of suitable level monitoring arrangements, and for this purpose in the present case for example load cells are provided on which the feed shaft 15 for the material for grinding is supported in a manner which is known per se.

Furthermore, fresh raw material is delivered—according to the arrow 17—as a first quantity of fresh material to the feed shaft 15 for material for grinding via the feed arrangement 8 in such a way that this delivery can be controlled or proportioned.

The material (arrow 18) which has undergone primary reduction in the first mill 1 of the first grinding stage is delivered preferably all together to the first air separator 2 with the aid of a lift-over arrangement, for example an elevator 19.

The second mill 3 which is constructed for fine reduction also feeds the material which is fine reduced in it—according to the arrows 20—via a lift-over conveyor arrangement, preferably an elevator 21, to the second air separator 4 of this second grinding stage. Whilst the fines running out of the fines outlets 4*c* of this second air separator 4 according to the arrows 22 are removed from the grinding plant as finished product, the quantity of oversize material discharged from the oversize material outlet (tailings outlet) 4*b* of this second air separator is returned as a second quantity of recycled material—according to the arrows 23—to the material inlet 3*a* of the second mill 3. In order to be able to determine the quantity of this second batch of recycled material (arrow 23) accurately, between the oversize material outlet 4*b* of the separator and the material inlet 3*a* of the second mill 3 it is passed over a suitable quantity measuring arrangement which in the present example can for instance be a suitable scale 24.

An electric or electronic control arrangement which is known per se is co-ordinated with the second grinding stage in such a way that the total quantity of material fed to the second mill 3, i.e. the sum of the fresh material batch (arrow 12) and the second batch of recycled material (arrow 23) can be kept constant, for which purpose the second batch of fresh material (arrow 12) delivered from the first separator 2 via the connecting conveyor 11 is regulated depending upon alterations in the quantities of recycled material and finished material (arrows 22 and 23) from the second separator 4. For this purpose the first regulating arrangement of the second grinding stage is connected to the variable-speed drive motor 9 of the separator cage 2*a* which determines the fineness by a first regulator ($F_{GK}$) 25 in such a way that in the event of the said alterations in the quantities of finished material and recycled material (22, 23) from the second grinding stage the quantity of fines (arrow 12) from the first separator 2 can be varied by means of the speed of rotation of its cage with a view to keeping the total quantity of feed material of this second mill 3 constant.

Furthermore, a second regulating arrangement—which also operates electrically or electronically—which is constructed in a manner which is known per se is coordinated with the first grinding stage. The way in which this second regulating arrangement is coordinated and constructed is such that in the event of an alteration of the first quantity of fines (12) and the first quantity of recycled material (13) from the appertaining first air separator 2 the first quantity of fresh material (17) can be varied by means of its feed arrangement 8 in order to keep the total quantity of feed material delivered to the first mill 1 constant. For this purpose the second regulating arrangement contains, in addition to the conventional adjustment and control arrangements, several regulators of which a regulator $F_{GP}$ is provided for quantity measurement signals from the belt scale 14 (to determine the first quantity of recycled material 13), a regulator $F_F$ to detect the quantity signals from the regulator $F_{GP}$ as well as the quantity or weight signals from the bunker proportioning scales 5*a*, 6*a*, 7*a*, and a further regulator L for determining the total quantity of feed material in the feed shaft 15 for material for grinding from the load cells 16. In all the regulating arrangements the appertaining connections are shown by broken lines.

The first mill 1 for the primary reduction in the first grinding stage and the second mill 3 for the fine reduction in the second grinding stage can each be of any suitable construction. However, it has proved to be particularly advantageous if, as is preferred in the embodiments described, the first mill 1 is formed by a roller mill which is known per se with two rollers 1*a*, 1*b*, of which at least one roller can be driven in a manner which is known per se and which form a grinding gap 1*c* between them for material bed crushing of the material for grinding which is delivered.

On the other hand, for the second grinding stage it is preferable to provide a drum mill or a tube mill as the second mill 3, in which the material for grinding is fine-reduced under the action of grinding elements, and it is particularly preferred to use a construction which is known per se as a ball mill.

The way in which the grinding plant illustrated in FIG. 1 is operated has already been disclosed essentially in the preceding description. Thus when this grinding plant is being operated in practice and for example a finer end product is required or when the feed material is more difficult to grind resulting in a reduction in the proportion of finished product (arrows 22) from the second separator 4 of the second grinding stage, then—with the throughput quantity kept constant—a correspondingly greater quantity of recycled material (arrows 23) is precipitated in this second separator 4 and will load the second mill 3. Accordingly, in order to keep the throughput quantity constant in this second grinding stage the quantity of fines (arrow 12) to be delivered to this second mill 3 as a quantity of fresh material from the first air separator 2 must be reduced correspondingly (by appropriate alteration of the speed of rotation of the separator cage 2*a*), so that the second total quantity of feed material to the second mill 3 can be kept constant by means of the first regulating arrangement. This means that a correspondingly greater quantity of oversize materials or first quantity of recycled material (arrows 13) is collected from the first air separator 2 of the first grinding stage, so that the first quantity of fresh material from the storage bunkers 5 to 7 to be delivered by the feed arrangement 8 to the feed shaft 15 for the material for grinding of the first mill 1 must be correspondingly reduced by means of the second regulating arrangement co-ordinated with this first grinding stage, so that the first total quantity of feed material of this first mill 1 can also be kept constant. This regulation with a view to keeping quantities constant operates in a correspondingly reversed manner if a greater proportion of fines (arrows 22) is removed as finished product from the second separator 4 of the second grinding stage.

Figure 2:
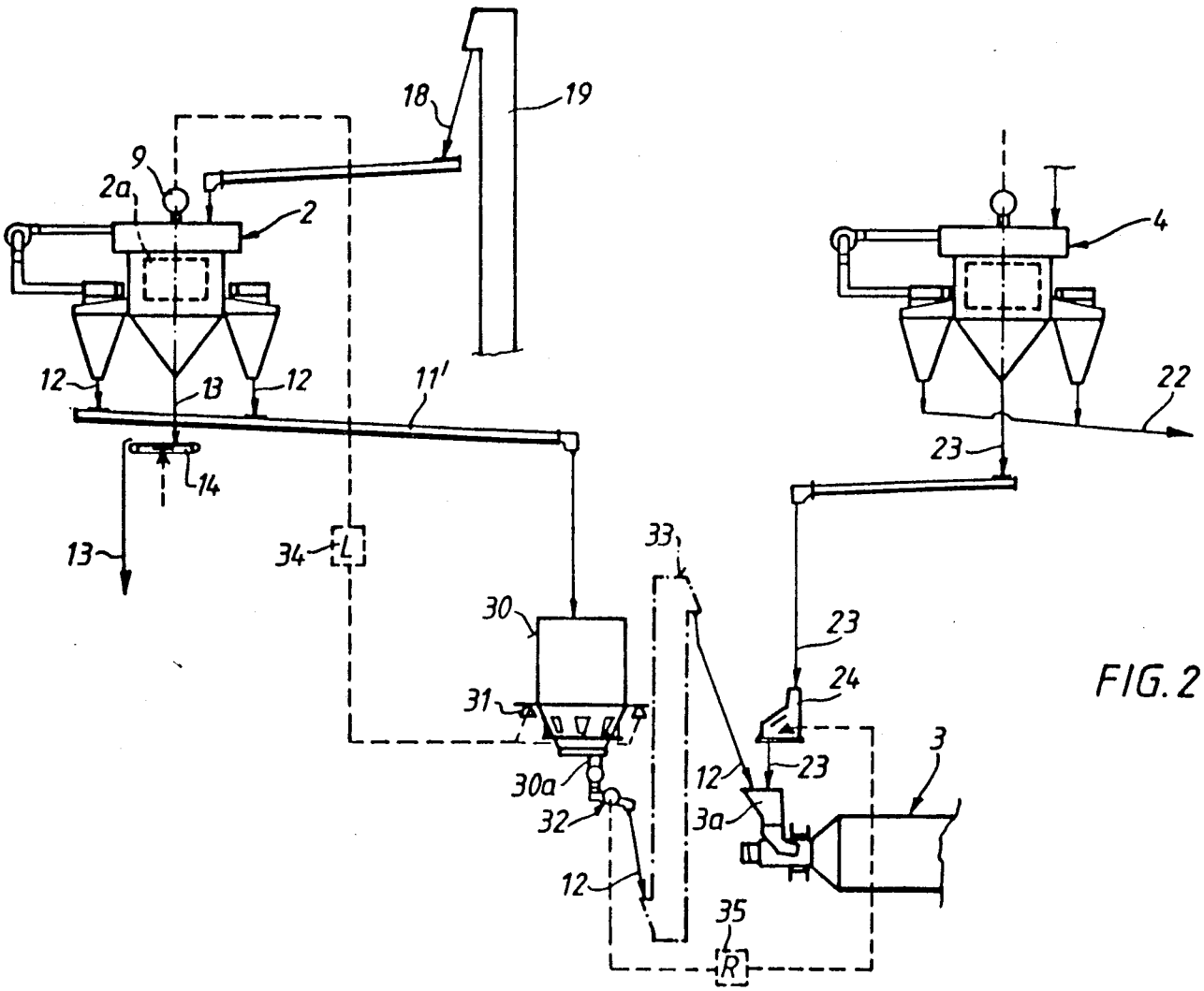
FIG. 2 shows a partial flow diagram of a second embodiment of the grinding plant, in which in particular the transition region from the first grinding stage to the second grinding stage is illustrated.

A second embodiment or a variant of the grinding plant already described with the aid of FIG. 1 is explained with the aid of the partial flow diagram according to FIG. 2, and in this connection above all only the parts of the plant which are necessary for this and in particular the connection region above all of the first grinding stage to the second stage are illustrated and explained. For the sake of simplicity all parts which are of similar construction to those of the first embodiment are designated by the same reference numerals as in the first embodiment (FIG. 1), so it is not necessary to describe these parts in detail again.

Whilst in the mixed plant according to the first embodiment (FIG. 1) the connecting arrangement for the delivery of the fines (arrow 12) coming from the first separator 2 of the first grinding stage is formed principally by a connecting conveyor, in this second embodiment (FIG. 2) this connecting arrangement contains in addition to the connecting conveyor 11' (as conveyor for fines) an intermediate silo 30 which is arranged between the connecting conveyor 11' and the material inlet 3*a* of the second mill 3 of the fine grinding stage and in which the quantity in the intermediate store can be controlled. For this purpose the intermediate silo 30 can be equipped with level control arrangements which are known per se or—as is preferred in this embodiment—can be arranged on load cells 31 in order to be able to control the quantities in the intermediate store in a suitable manner. An outlet proportioning device 32 of a construction which is known per se is co-ordinated with the outlet 30*a* of this intermediate silo 30. It is only by this outlet proportioning device 32 that the fines (arrow 12) coming from the first separator 2 are delivered as a second batch of fresh material accurately and with variable control (proportioning) to the material inlet 3*a* of the second mill 3, together with the second quantity of recycled material (arrows 23) returned from the second separator 4 of the second grinding stage; if required, a further lift-over elevator can be arranged between the outlet proportioning device 32 and the material inlet 3*a* of the second mill 3, as is indicated by dash-dot lines at 33.

In this variant according to FIG. 2 the first regulating arrangement for the second grinding stage differs in that a first regulator (L) 34 is arranged in the control connection—only indicated by broken lines—between the load cells 31 of the intermediate silo 30 and the variable-speed drive motor 9 for the separator cage 2*a* of the first air separator 2 and a second regulator (R) 35 of this first regulating arrangement is arranged in a control connection—also indicated only by broken lines—between the device for measuring the quantities of recycled material which is constructed as a scale 24 and the outlet proportioning device 32.

Thus in this case (FIG. 2) the quantity of fines (arrows 12) to be delivered from the first separator (2) of the first grinding stage to the material inlet 3*a* of the second mill 2 can first of all be put into intermediate store before being passed together with the second quantity of recycled material (arrows 23) from the second separator 4, that is to say before the said material inlet 3*a* of the mill, and is then called off in a controlled manner in a quantity adapted for keeping constant with the second batch of recycled material (arrows 23) delivered from the second separator 4. Accordingly, in this case too the quantity of fresh material (batch of fines 12 from the first separator 2) which is necessary for keeping the total quantity of feed material to the second mill 3 constant is regulated by appropriate adaptation of the speed of the separator cage 2*a* and thus of the fineness of separation in this first separator 2.

Whereas with the aid of FIGS. 1 and 2 embodiments of grinding plants and reduction methods have been described in which each grinding stage operates in the manner of a closed-circuit grinding system and each has a mill and an appertaining air separator, according to a particularly simple embodiment it is also possible to omit the separator in the second grinding stage and to remove all of the material fine-reduced in the second mill of the second grinding stage as finished material (quantity of finished material). Since this second mill is preferably constructed as a tube mill, ball mill or the like, it is possible here for the air stream to be passed through this second mill to adjusted so that the material which is sufficiently fine-reduced and discharged from this mill can all be removed as finished product. In this case the fresh material delivered from the separator of the first grinding stage to the second mill of the second grinding stage forms the total quantity of feed material to this second mill, in which case the keeping constant is achieved depending upon the fine-reduced material discharged as a quantity of finished product from the second mill with the aid of the fineness adjustment device of the air separator of the first grinding stage. The mode of operation should be easy to imagine without additional illustration since—by comparison with the embodiments according to FIGS. 1 and 2—it is essentially only the second air separator which is omitted.

Moreover, it is also possible in principle for the second air separator to be retained and nevertheless to remove all of the material separated in the separator as finished product since the proportion of fines constitute a finer first quantity of finished product and the oversize material (tailings) constitute a coarser second quantity of finished product.

We claim:

1. A method for two-stage grinding of brittle material comprising:

a) subjecting fresh brittle material to primary reduction in a first mill;

b) separating reduced fresh material into a quantity of first oversize material and a quantity of first fines;

c) recycling the quantity of first oversize material to the first mill;

d) delivering the quantity of first fines to a second mill for further reduction;

e) separating material which has been reduced in the second mill into a quantity of second oversize material and a quantity of second fines;

f) recycling the quantity of second oversize material to the second mill;

g) removing the quantity of second fines as a finished product;

h) varying the quantity of first fines corresponding to an alteration of the quantity of second oversize material by adjusting the fineness of separation of the first separator to maintain constant the total quantity of first fines and second oversize material delivered to the second mill; and i) varying the quantity of fresh material corresponding to an alteration of the quantity of first oversize material to maintain constant the total quantity of first oversize material and fresh material delivered to the first mill.

2. A method according to claim 1 wherein the separation of the reduced fresh material is effected in a separator having a rotating centrifugal air separator and wherein the fineness of separation is adjusted by varying its rotational speed.

3. A method according to claim 1 wherein said first mill comprises a roller mill.

4. A method according to claim 1 wherein said second mill comprises a ball mill.

5. A method according to claim 1 including storing the quantity of first fines prior to delivering said first fines to the second mill.

6. Apparatus for two-stage grinding of brittle material comprising:

a) a first reduction mill;

b) feed means for supplying fresh brittle material to said first reduction mill;

c) adjustable first separator means for classifying reduced material into a quantity of first oversize material and a quantity of first fines;

d) means for recycling said first of oversize material to said first mill;

e) a second reduction mill;

f) means for delivering said first fines to said second mill;

g) second separator means for classifying material reduced in said second mill into a quantity of second oversize material and a quantity of second fines;

h) means for recycling said second oversize material to said second mill;

i) means for removing said second fines as a finished product;

j) first control means for maintaining constant the total quantity of material delivered to said second mill by varying said quantity of first fines corresponding to an alteration of said quantity of second oversize material, said first control means including means for varying said quantity of first fines by adjusting said first separator; and k) second control means for keeping constant the total quantity of material delivered to said first mill by varying the supply of fresh material corresponding to an alteration of said quantity of first oversize material.

7. Apparatus according to claim 6 wherein said first separator means comprises a centrifugal air separator having a variable speed rotational drive.

8. Apparatus according to claim 6 wherein said first mill comprises a roller mill.

9. Apparatus according to claim 6 wherein said second mill comprises a ball mill.

10. Apparatus according to claim 6 including storage means between said first separator means and said second mill for storing said quantity of first fines.

* * * * *